US007343890B1

(12) United States Patent
Platt

(10) Patent No.: US 7,343,890 B1
(45) Date of Patent: Mar. 18, 2008

(54) TWO-PIECE VALVE COVER

(76) Inventor: Richard B. Platt, 381 Country Club La., Grosse Pointe Farms, MI (US) 48236

( * ) Notice: Subject to any disclaimer, the term of this patent is extended or adjusted under 35 U.S.C. 154(b) by 0 days.

(21) Appl. No.: 11/526,425

(22) Filed: Sep. 25, 2006

(51) Int. Cl.
*F01M 9/10* (2006.01)

(52) U.S. Cl. ..... 123/90.38; 123/195 C

(58) Field of Classification Search ..... 123/90.38, 123/195 C, 90.33, 90.37, 90.39, 188 E
See application file for complete search history.

(56) References Cited

U.S. PATENT DOCUMENTS

| | | | | |
|---|---|---|---|---|
| D252,878 | S | 9/1979 | Bellino et al. | |
| 4,388,898 | A * | 6/1983 | Larson | 123/90.38 |
| 4,492,189 | A * | 1/1985 | Ogawa et al. | 123/90.38 |
| 4,538,560 | A | 9/1985 | Alden | |
| 4,788,950 | A * | 12/1988 | Finley | 123/195 C |
| D305,123 | S | 12/1989 | Garrett et al. | |
| D305,767 | S | 1/1990 | Tauschke | |
| D306,735 | S | 3/1990 | Finley | |
| D324,867 | S | 3/1992 | Lyndhurst et al. | |
| 5,367,993 | A | 11/1994 | Tulach et al. | |
| 5,513,604 | A | 5/1996 | Clement | |
| 5,655,489 | A * | 8/1997 | Kammerer et al. | 123/90.38 |
| D418,844 | S | 1/2000 | Occhiuto | |
| D422,551 | S | 4/2000 | Haines | |
| 6,382,158 | B1 | 5/2002 | Durnen | |
| 6,491,014 | B1 * | 12/2002 | Eickert | 123/195 C |
| D479,244 | S | 9/2003 | Kern et al. | |
| D479,721 | S | 9/2003 | Kern et al. | |
| D503,724 | S | 4/2005 | Grant | |
| D531,641 | S | 11/2006 | Schultz et al. | |
| D533,567 | S | 12/2006 | D'Amico | |
| D543,998 | S * | 6/2007 | Platt | D15/5 |

* cited by examiner

*Primary Examiner*—Zelalem Eshete
(74) *Attorney, Agent, or Firm*—Dickinson Wright PLLC

(57) ABSTRACT

A two-piece valve cover for use on an engine having an engine cylinder head and a plurality of valve rocker arms. The two-piece valve cover includes a base housing for sealing with the cylinder head and a top cover. The top cover includes a sealing flange adapted to receive a sealing gasket member. The second sealing gasket member is retained on the top cover for forming a seal between said top cover and said base housing.

14 Claims, 3 Drawing Sheets

TWO-PIECE VALVE COVER

BACKGROUND OF THE INVENTION

1. Technical Field

This invention is related to the field of internal combustion engines having valve train assemblies covered by valve covers. More specifically, this invention relates to two-piece valve covers.

2. Discussion

Valve train assemblies include, amongst other items, valve rocker arms and push rods lubricated with engine oil. In order to maintain the effective and efficient working of such valve train assemblies, such assemblies must remain lubricated and must be protected from debris in the engine compartment. As such, valve train assemblies are usually provided with a cover, more commonly referred to as a valve cover, attached to the engine in order to prevent the loss of engine oil and to protect such assemblies from debris.

The valve covers are attached to the engine with the use of a gasket and various fasteners. The gasket provides for an effective sealing arrangement between the valve cover and the engine head. Some examples of such gaskets are known to be O-ring type gaskets having a circular cross section, flat type gaskets having a rectangular-like cross section, and custom molded gaskets having a variety of cross-sections. In some cases, the gasket is placed on a sealing surface of an engine head with the use of a sealing compound in order to assist in retaining the gasket on the engine head while locating and attaching the valve cover to the engine head and in some cases, mechanical fasteners can accomplish the same purpose. The mechanical fasteners are usually threaded bolts or stud and nut combinations.

To permit the repair of valve train components, the valve covers must be removed in order to provide access to such components. After removing the fasteners retaining the valve cover to the engine head, the valve cover is removed from the engine head to thereby expose the valve train components for inspection, adjustment, and repair. Usually when removing the valve cover, the engine oil found in the cylinder head area can spill out into other areas of the engine compartment and the adjacent floor surface causing a considerable mess. In the case of racing activities involving an engine, the valve train assemblies play an important role in such activities and, as such, the immediate need to remove the valve covers quickly, easily, and neatly becomes important. In such cases, mechanics need to have rapid access to the valve train in order to inspect, adjust, or repair certain components of the valve train.

Prior art valve covers include both one and two-piece valve covers. Such prior art valve covers are typically made by stamping steel or by casting various materials. Usually, the prior art valve covers are heavy or utilize a significant and costly amount of material since a substantial wall and mounting flange thickness is needed to provide for a distortion-resistant and leak-resistant flange to seal the engine reliably or, in the case of a two-piece valve cover, to seal both pieces of the two-piece valve covers together reliably. These heavy and substantial prior art valve covers are time consuming and difficult to assemble to, and remove from, the engine. In addition, prior art valve covers utilize old conventional sealing arrangements which add cost and complexity to the valve covers. Such old conventional sealing arrangements for one and two-piece valve covers are known to include features on the mounting flange (the portion of the cover configured to seal with the engine head) for retaining a gasket to such flange. Such covers having retaining features on the mounting flange require a larger dimension and/or greater wall thickness thereby increasing weight and material consumption. Also, another deficiency of the prior art is the failure to provide for the retention of engine oil upon the removal of the prior art valve covers from the engine head, such failure occurring whether the engine is turned off or operating.

SUMMARY OF THE INVENTION

In view of the above, the present invention is directed to a two-piece valve cover providing for the easy and rapid removal and replacement of a top portion of the two-piece valve cover.

Another object of the invention is to provide for a lightweight two-piece valve cover.

Another object of the invention is to minimize oil spillage whether the engine is turned off or operating;

Another object of the invention is to provide for a two-piece valve cover which minimizes the amount of material used in the manufacture thereof.

Another object of the invention is to provide for an effective seal between the two portions of a two-piece valve cover.

In accordance with a preferred embodiment of the present invention, a two-piece valve cover for use on an engine having an engine cylinder head and a plurality of valve rocker arms is provided. The two-piece valve cover includes a base member for sealing a base housing to the cylinder head through the use of a first sealing gasket member. The base housing includes an inner region surrounding the plurality of valve rocker arms and a flange on the base housing extending outwardly from the inner region and around at least a portion of the base housing. The two-piece valve cover further includes a top cover for sealing engagement with the base housing through the use of a second sealing gasket member. The top cover includes a sealing flange extending around at least a portion of the top cover and a lip portion extending toward the base housing for locating the top cover on the base housing. The second sealing gasket member is retained on the top cover for forming a seal between the top cover and the base housing.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 1:
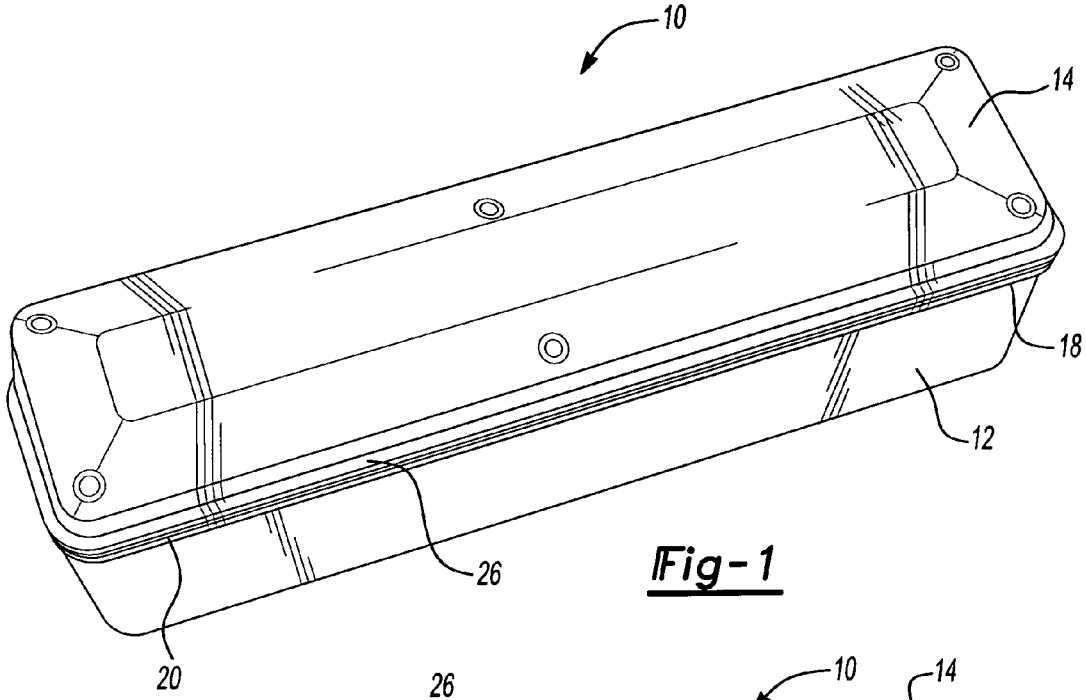
FIG. 1 is a perspective view of a preferred embodiment of the invention.
Figure 2:
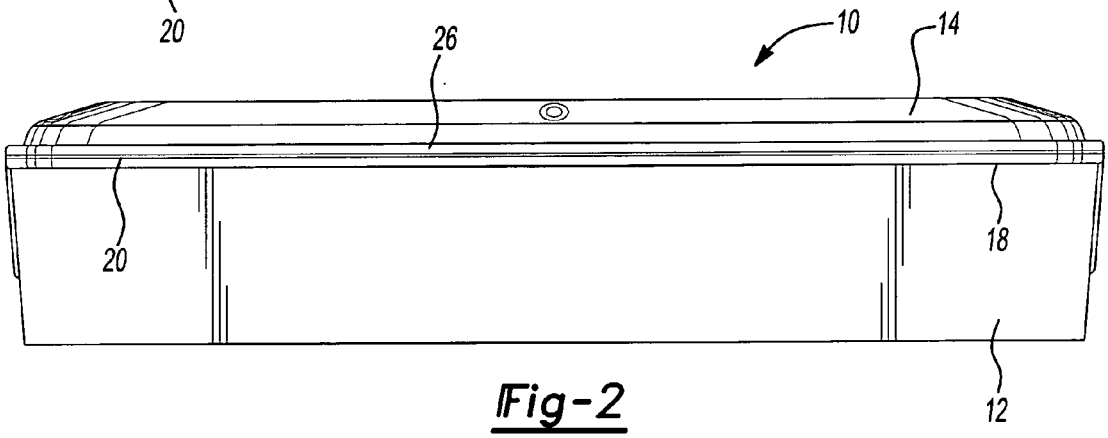
FIG. 2 is a side view of a preferred embodiment of the invention.
Figure 3:
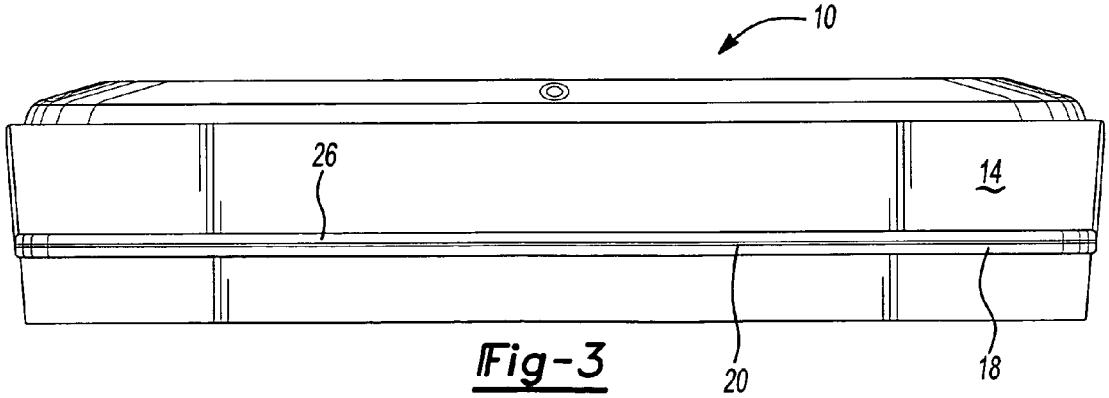
FIG. 3 is a side view of a preferred embodiment of the invention.
Figure 5:
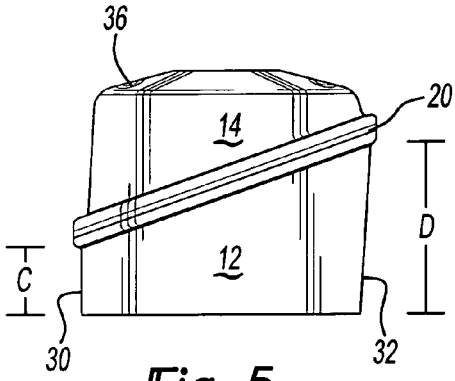
FIG. 5 is an end view of a preferred embodiment of the invention.
Figure 6:
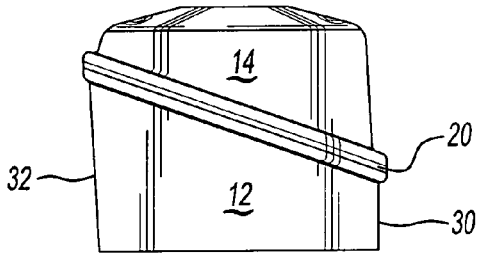
FIG. 6 is an end view of a preferred embodiment of the invention.
Figure 7:
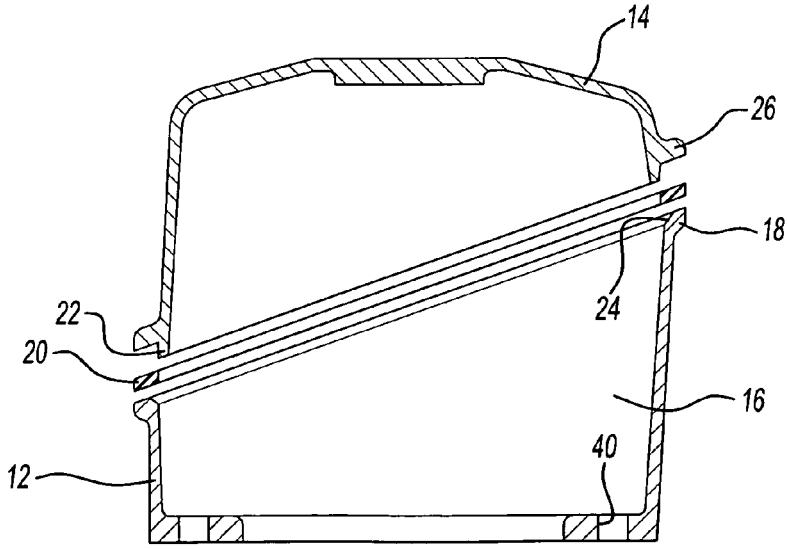
FIG. 7 is a cross-section end view taken along line A-A in FIG. 4.
Figure 8:
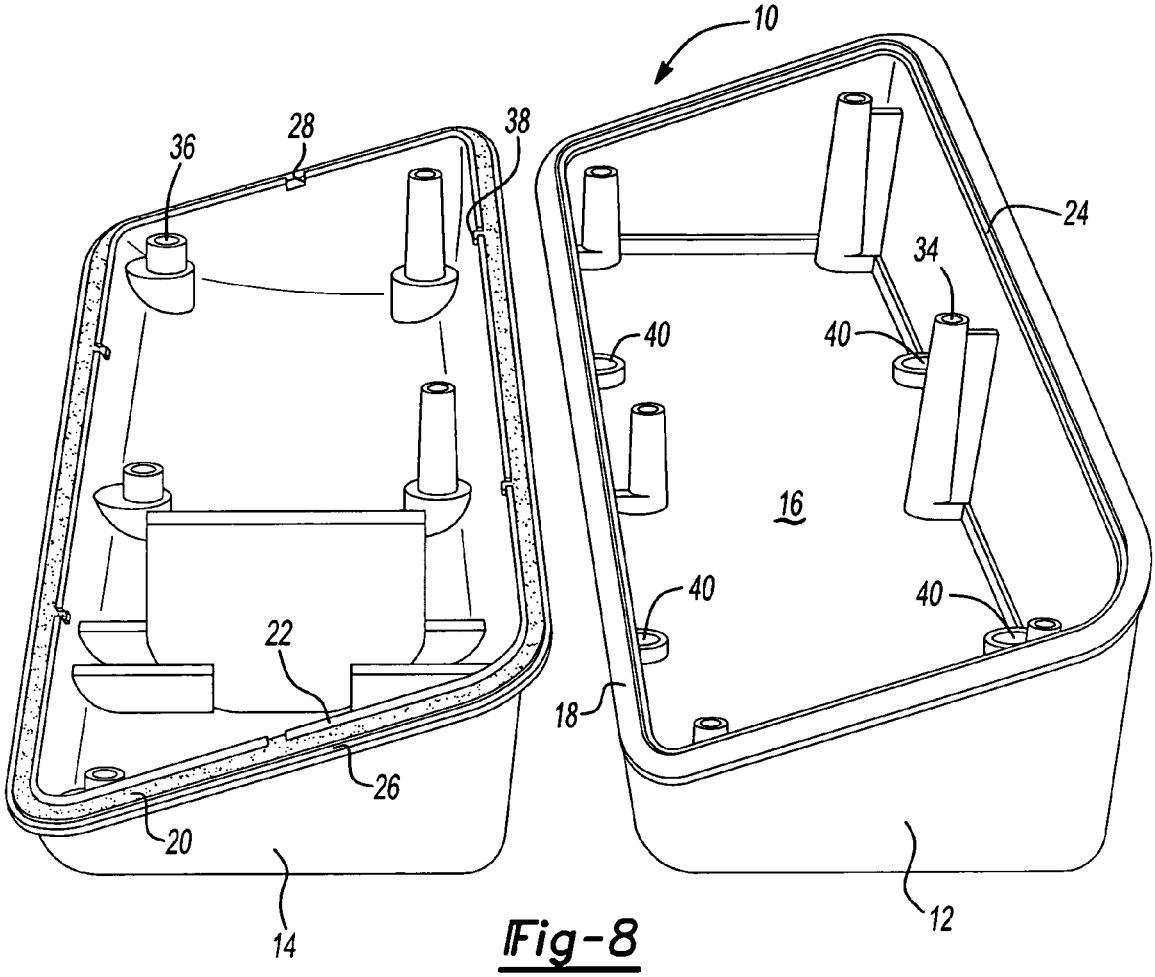
FIG. 8 is a perspective view of a preferred embodiment of the subject invention in a disassembled state.

In accordance with the illustrated embodiment of the present invention, FIGS. 1-8 show a preferred embodiment of the two-piece valve cover. As shown in FIGS. 1-3, the two-piece valve cover generally shown at 10 includes a base housing 12 and a top cover 14. The base housing 12 is adapted for sealingly engaging a cylinder head of an engine through the use of a first sealing gasket member (not shown). It should be appreciated that the first sealing gasket may be made of several types of known materials and configurations including, for example, an O-ring type gasket. The base housing 12 further includes a base housing flange 18 extending around the base housing 12 and outwardly from an inner region 16, as shown in FIGS. 7 and 8. The inner region 16 is configured for surrounding a valve train assembly (not shown) of an engine. In this embodiment, the base housing flange 18 extends continuously around the base housing 12; however, it should be appreciated that other embodiments may include the base housing flange 18 extending around portions of the base housing 12.

Figure 4:
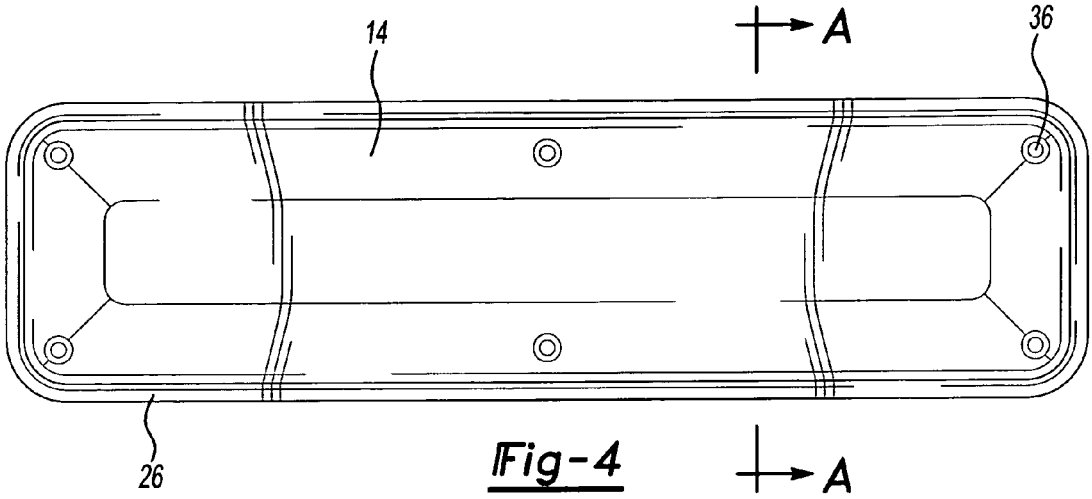
FIG. 4 is a plan view of a preferred embodiment of the invention.

FIG. 4 is a plan view of the present invention showing a sealing flange 26 extending around the top cover 14 and adapted for mating with the base housing flange 18 of the base housing 12 during assembly, as shown in FIGS. 1 and 2. As shown in FIGS. 5-8, the top cover 14 is adapted for sealingly engaging the base housing 12 with the use of a second sealing gasket member 20. The second sealing gasket member 20 is adapted to be retained on the sealing flange 26 of the top cover 14. Compared to prior art valve covers, the top cover 14 includes a very thin wall thickness. A wall thickness of approximately 2.8 mm to 3.0 mm for the top cover 14 has been found to provide a sufficient structural stiffness while reducing the overall weight of the top cover 14. The top cover 14 includes a lip portion 22 extending in a direction towards the base housing 12. In this embodiment, the lip portion 22 is configured to abut an inner surface 24 of the base housing 12. As more fully described below, the lip portion 22 is useful during the assembly of the top cover 14 to the base housing 12 in that the lip portion 22 interfaces with the inner surface 24 of the base housing 12 to position the top cover 14 on the base housing 12.

The base housing 12, as shown in FIGS. 5 and 6, includes a first 30 and second 32 wall portion. The first wall portion 30 includes a wall height C, extending in a direction away from the engine (not shown), which is less than a wall height D of the second wall portion 32. In this embodiment, as more fully described below, the wall height C and the second wall height D are configured such that the base housing flange 18 is substantially parallel to a horizontal axis of the engine 42 as shown along line II in FIG. 9. It has been found that by providing the base housing 12 with varying wall heights, such that the base housing flange 18 is substantially parallel to a horizontal axis of the engine 42, any oil that may be in the valve rocker arm area region while the engine is running is retained in the inner region 16 of the base housing 12 upon removal of the top cover 14 from the base housing 12.

FIG. 8 shows the two-piece valve cover 10 in its unassembled state and more specifically the top cover 14 shown upside down. The top cover 14 includes retention features 28 adapted to retain the second sealing gasket member 20 to the top cover 14. As shown in FIG. 8, in its unassembled state, the two-piece valve cover 10 includes the second sealing gasket member 20 retained on the sealing flange 26 of the top cover 14. In this embodiment, the retention features 28 are shaped as notches in the lip portion 22; however, it should be appreciated that other various retention features may be used. The second sealing gasket member 20 is substantially flat in FIG. 8; however, it should be appreciated that other configurations and cross-sections of a gasket including, for example, an O-type ring type sealing gasket may be used. Also, the second sealing gasket member 20 includes tabs 38 for use in connection with the retention feature 28. Since the top cover 14 includes the lip portion 22 having retention features 28 for retaining the second sealing gasket member 20 thereto, it has been found that the material thickness of the top cover 14 and the base housing 12 can be minimized. In minimizing the material thickness of the top cover 14, the overall weight and material cost of the top cover 14 are also reduced.

FIG. 8 further shows apertures 34 formed on the inner region 16 of the base housing 12. The top cover 14, as shown in FIG. 8, includes bores 36 extending through the top cover 14 and configured in alignment with the apertures 34 of the base housing 12 for receiving a fastener (not shown) therein for retaining the first cover 14 to the base housing 12. Base housing 12 includes bores 40 for use in connection with a fastener (not shown) to attach the base housing 12 to the engine head. It should be appreciated that the top cover 14 may be fastened to the base housing 12 through the use of many types of fasteners, including, for example, a bolt.

The top cover 14 and the base housing 12 can be made by casting materials including aluminum, magnesium, plastic, and steel. It should be appreciated that, although the present embodiment of the subject invention is shown as a cast part, the base housing 12 may also be made from stamping steel.

Figure 9:
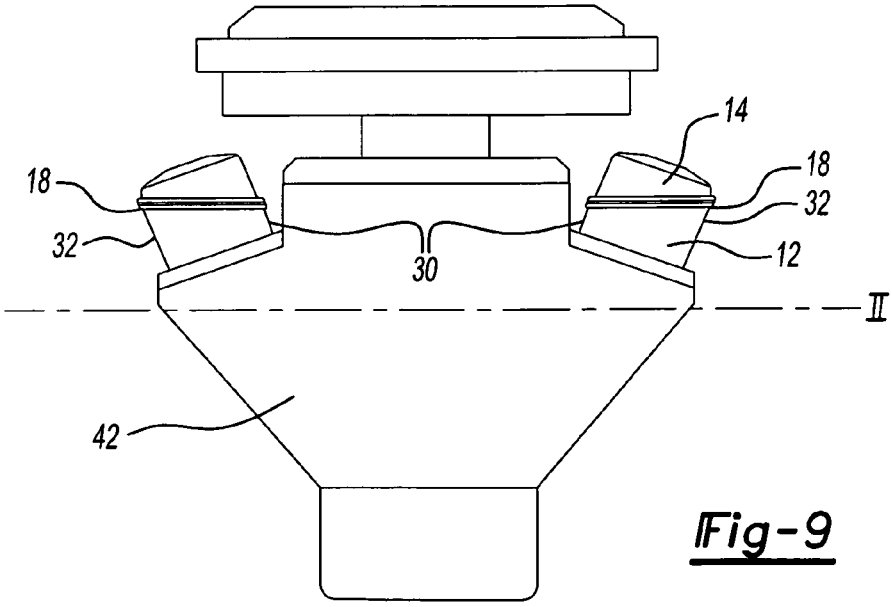
FIG. 9 is an end view of an engine showing a preferred embodiment of the invention.

During assembly of the two-piece valve cover 10 to the engine, the base housing 12 is attached to the head of the engine having the wall portions 30, 32 selected and positioned to be substantially parallel to a horizontal axis of the engine, as shown along line II in FIG. 9. After sealingly attaching the base housing 12 to the head of the engine, with use of the a first sealing gasket (not shown) and fastener extending through bores 40, the top cover 14 is fitted with the second sealing gasket member 20 such that the gasket 20 is retained to the top cover 14 as shown in FIG. 8. The top cover 14 is then positioned and aligned with the base housing 12 by inserting the lip portion 22 inside the base housing 12 and abutting the inner surface 24 as shown in FIG. 7. Fasteners are inserted into bores 36 on the top cover 14 and extend into apertures 34 of the base housing 12. In this embodiment, the fasteners and the apertures 34 are configured with threads. In the case of racing activities involving engines, the top cover 14 can be easily removed from the base housing 12 by removing the fasteners. When the top cover 14 is removed, the second sealing gasket member 20 remains retained to the top cover 14 and, since the base housing 12 is configured with different wall heights C and D, much of the lubricating engine oil is retained in the inner region 16 of the base housing 12, even when the engine is operating.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A two-piece valve cover for use on a V-shaped engine having an engine cylinder head and a plurality of valve rocker arms, said cover comprising:

a base housing for sealing engagement to the cylinder head through the use of a first sealing gasket member and having an inner region surrounding said plurality of valve rocker arms;

a base housing flange on said base housing extending around at least a portion of said base housing;

said base housing includes first and second wall portions each having a wall height wherein said wall height of said first wall portion is different than said height of said second wall portion;

said wall height of said first wall portion is less than said wall height of said second wall portion such that said base housing flange of said base housing extends along a plane parallel to an axis of said engine wherein said axis of said engine is horizontal;

a top cover for sealing engagement to said base housing through the use of a second sealing gasket member and having a sealing flange extending around at least a portion of said top cover; and said second sealing gasket member retained on said top cover for forming a seal between said top cover and said base housing.

2. The two-piece valve cover of claim 1, wherein said second sealing gasket member is substantially flat prior to sealing said top cover to said base housing.

3. The two-piece valve cover of claim 1, wherein said base housing includes at least one aperture through which at least one fastener can be inserted to secure said base housing to said engine cylinder head.

4. The two-piece valve cover of claim 3, wherein said aperture is located in said inner region of said base housing.

5. The two-piece valve cover of claim 1, wherein said top cover includes at least one aperture through which at least one fastener can be inserted to secure said top cover to said base housing.

6. The two-piece valve cover of claim 5, wherein said aperture is located in said inner region of said top cover.

7. The two-piece valve cover of claim 1, wherein said top cover includes a wall having a small thickness.

8. The two-piece valve cover of claim 7, wherein said wall is manufactured with a material chosen from the group consisting of aluminum, magnesium, plastic and steel.

9. The two-piece valve cover of claim 7, wherein said at least one of said top cover and said base housing is formed with reinforced plastic material.

10. The two-piece valve cover of claim 1, wherein said top cover sealing flange extends outwardly from an outer surface of said top cover.

11. The two-piece valve cover of claim 1, wherein said second sealing gasket member is exposed to an exterior of said two-piece valve cover.

12. The two-piece valve cover of claim 1, wherein said top cover includes a lip portion for locating said top cover on said base housing.

13. The two-piece valve cover of claim 12, wherein said lip portion includes at least one retention feature for fixedly retaining said second sealing gasket member to said top cover.

14. The two-piece valve cover of claim 1, wherein said top cover includes at least one retention feature for fixedly retaining said second sealing gasket member to said top cover.

* * * * *